US005941222A

United States Patent [19]

Braly

[11] Patent Number: 5,941,222

[45] Date of Patent: Aug. 24, 1999

[54] OPTIMIZING THE EFFICIENCY OF AN INTERNAL COMBUSTION ENGINE

[75] Inventor: George W. Braly, Ada, Okla.

[73] Assignee: General Aviation Modifications, Inc., Ada, Okla.

[21] Appl. No.: 09/003,190

[22] Filed: Jan. 6, 1998

Related U.S. Application Data

[60] Provisional application No. 60/034,903, Jan. 7, 1997.

[51] Int. Cl.[6] ..... F02D 41/00

[52] U.S. Cl. ..... 123/676; 123/456; 29/888.01

[58] Field of Search ..... 123/456, 676; 29/888.01

[56] References Cited

U.S. PATENT DOCUMENTS 5,189,782 3/1993 Hickey ..... 123/470

OTHER PUBLICATIONS

B. W. Weinstein, "Balancing fuel flows among cylinders," ABS Newsletter, vol. 93 (No. 7), (Jul. 21, 1993).

*Primary Examiner*—Erick R. Solis
*Attorney, Agent, or Firm*—Crowe & Dunlevy

[57] ABSTRACT

A fuel injector matrix to optimize the operating efficiency of an internal combustion engine, each injector having a metering orifice sized for each of the combustion cylinders of the engine to provide a uniform fuel to air ratio to all the cylinders such that all the cylinders reach a peak exhaust gas temperature at a common total engine fuel flow.

4 Claims, 5 Drawing Sheets

| NO. OF CYLINDERS= | 6 | | | | | | | | LINE | |
|---|---|---|---|---|---|---|---|---|---|---|
| | | CYL 1 | CYL 2 | CYL 3 | CYL 4 | CYL 5 | CYL 6 | AVG. FUEL FLOW AT PEAK | 1 | VARIABLE |
| TOTAL ENGINE FUEL FLOW WHEN EACH NOZZLE PEAKS, IN GPH, PPH, OR LPH: | A | 89.0000 | 88.0000 | 85.0000 | 85.0000 | 82.5000 | 82.5000 | 85.3333 | 2 | TEFFx, TEFFavg |
| FLOW AS FRACTION OF AVERAGE FLOW | | 1.0430 | 1.0313 | 0.9961 | 0.9961 | 0.9668 | 0.9668 | 1.0000 | 3 | Fn-fraction |
| PERCENT RICH(+) OR LEAN (-) | | -4.2969 | -3.1250 | 0.3906 | 0.3906 | 3.3203 | 3.3203 | | 4 | Px=TEFF |
| | | | | | | | | | | |
| ACTUAL NOZZLE BENCH FLOW AT SPEC PRESSURE: | B | 29.3000 | 29.7500 | 29.3000 | 29.3000 | 29.3000 | 29.3000 | 29.3750 | 5 | NFx-actual, Nfavg-actual |
| PERCENT NOZZLE IS RICH(+) OR LEAN (-) OF AVERAGE ACTUAL NOZZLE FLOW: | | -0.2553 | 1.2766 | -0.2553 | -0.2553 | -0.2553 | -0.2553 | | 6 | Px-actual |
| | | | | | | | | | | |
| SPEC NOZZLE FLOW (PPH) | C | 29.3000 | 29.3000 | 29.3000 | 29.3000 | 29.3000 | 29.3000 | 29.3000 | 7 | Savg |
| RATIO OF ACTUAL TO SPEC NOZZLE SIZE | | 1.0000 | 1.0154 | 1.0000 | 1.0000 | 1.0000 | 1.0000 | | | |
| | | | | | | | | | | |
| NET (CORRECTED FOR KNOWN NOZZLE SIZING) CYLINDER RICH (+) OR LEAN (-) IN PERCENT FROM UNIFORM: | | -4.0416 | -4.4016 | 0.6459 | 0.6459 | 3.5756 | 3.5756 | 0.0000 | 8 | Px-net |
| | | | | | | | | | | |
| PRELIMINARY RE-SIZING: | | 30.5590 | 30.6797 | 29.1855 | 29.1855 | 28.3271 | 28.3271 | 29.3773 | 9 | Sx-preliminary, Savg-preliminary |
| RECOMMENDED NEW SIZE BASED ON AVERAGE FLOWS OF EXISTING NOZZLES: | D | 30.5565 | 30.6772 | 29.1832 | 29.1832 | 28.3249 | 28.3249 | 29.3750 | 10 | Sx-resized, Savg-resized |
| PERCENT INCREASE(+)/ DECREASE (-): | | 4.2886 | 3.1168 | -0.3986 | -0.3986 | -3.3280 | -3.3280 | -0.0080 | | |
| | | | | | | | | | | |
| SPEC NOZZLE RE-SIZING | | | | | | | | | | |
| RECOMMENDED NEW SIZE FOR NOZZLES BASED ON THE NOMINAL OR SPEC SIZE: | E | 30.4842 | 30.5897 | 29.1107 | 29.1107 | 28.2523 | 28.2523 | 29.3000 | 11 | Sx-new |
| PERCENT INCREASE(+)/ DECREASE (-): | | 4.0416 | 4.4016 | -0.6459 | -0.6459 | -3.5756 | -3.5756 | 0.0000 | | |

FIG. 3

OPTIMIZING THE EFFICIENCY OF AN INTERNAL COMBUSTION ENGINE

RELATED APPLICATIONS

This application claims priority to U.S. Provisional Application Ser. No. 60/034,903 filed Jan. 7, 1997, hereby incorporated by reference.

BACKGROUND

1. Field of the Invention

The present invention relates generally to optimizing the efficiency of a port injected internal combustion engine, and more particularly but not by way of limitation to the balancing of the fuel to air ratio in all combustion cylinders so that each cylinder reaches a peak exhaust gas temperature at a common total engine fuel flow rate.

2. Discussion

Manipulating the fuel to air ratio in an internal combustion engine is commonly done by those skilled in the art in order to achieve the engine's rated performance characteristics, such as power and fuel consumption. Generally, there is a ratio that produces a maximum exhaust gas temperature (hereinafter "EGT"), occurring at the stoichiometric balance point where just enough combustion air is available for complete combustion of the fuel. Operating the engine above this ratio, rich of peak EGT, is typically advantageous in achieving maximum power such as during acceleration of an automobile or take-off and climb of an airplane. Conversely, operating the engine below this ratio, lean of peak EGT, is typically advantageous in achieving fuel savings when maximum power is not needed. Operating in the lean of peak EGT range furthermore provides the advantage of reduced cylinder head temperatures.

Many engines in service today, however, are inherently incapable of realizing the benefits of operating in the lean of peak EGT range due to cylinder-to-cylinder variation in fuel to air ratios. The imbalance means that individual cylinders reach a peak EGT at different total engine fuel flow rates. This produces a condition whereby at any given total engine fuel flow rate the individual cylinders are producing different horsepower values. On the rich side of peak EGT this condition is usually insignificant because the corresponding horsepower curve is typically flat in that range. On the lean side of peak EGT, however, this condition is usually significant because the corresponding horsepower curve typically drops off steeply in that range.

It is well known that an engine with such an inherent imbalance will run rough when leaned because the variations in power produced by combustion are transferred by the pistons to the crankshaft. The net result is an unbalanced torque on the crankshaft which produces vibration and roughness in the engine. To prevent vibration and rough running, the engine must be operated in the rich ratio range where the horsepower curve is relatively flat, where cylinder to cylinder variations in the fuel to air ratio and corresponding EGTs have little effect on engine horsepower.

Others have suggested the cause of the inherent variation in fuel to air ratio among cylinders is due to an uneven distribution of combustion air to the engine cylinders. Although this is a possible cause in a few poorly designed air distribution systems, addressing the problem from the standpoint that an air pressure differential exists in many engines, such as those employing a runner-riser air induction system, has yielded limited results. What is obviously overlooked by this approach is that an uneven air distribution would create roughness and vibration at all ratios rich of peak. Those skilled in the art will recognize that the problematic conditions of engine roughness and vibration are primarily associated with operating the engine in the lean ratio range.

What the prior references fail to teach is that in addition to air flow unbalance there are other contributing factors, such as that of occult fuel transfer and of injector variation. Occult fuel transfer occurs as rich mixtures in the inlet port of upstream cylinders is sucked into the combustion airstream of downstream cylinders when the upstream cylinder inlet port is closed. Injector variation comes from the common-place manufacturing tolerance or out of spec condition of an injector or its associated distribution system.

What is lacking in the industry is an approach that provides a matrix of fuel injectors, that is, a matched injector size for each cylinder, to provide an engine that equalizes the fuel to air ratio in all cylinders such that all cylinders reach a peak EGT at a common total engine fuel flow rate. Such a method would compensate for the variation caused by inherent engine conditions of construction such as occult fuel transfer and unbalanced combustion air, as well as fuel injector variation.

BRIEF DESCRIPTION OF THE SEVERAL VIEWS OF THE DRAWINGS

FIG. 3 presents a table of sample calculations illustrating the method of the present invention for determining the fuel injector matrix to balance the fuel to air ratio in all combustion cylinders of an internal combustion engine.

DESCRIPTION

The present invention presents an apparatus and a methodology for solving the problem of unbalanced fuel to air ratios among the combustion cylinders in many port injected internal combustion engines in use today. The following discussion presents an embodiment of the present invention in an aircraft engine, but the invention's scope is not limited to engines employed in an aircraft. Other types of vehicles, such as automobiles, boats and the like, are known to use port injected engines and can likewise benefit from the principles and practice of the present invention.

Figure 1:
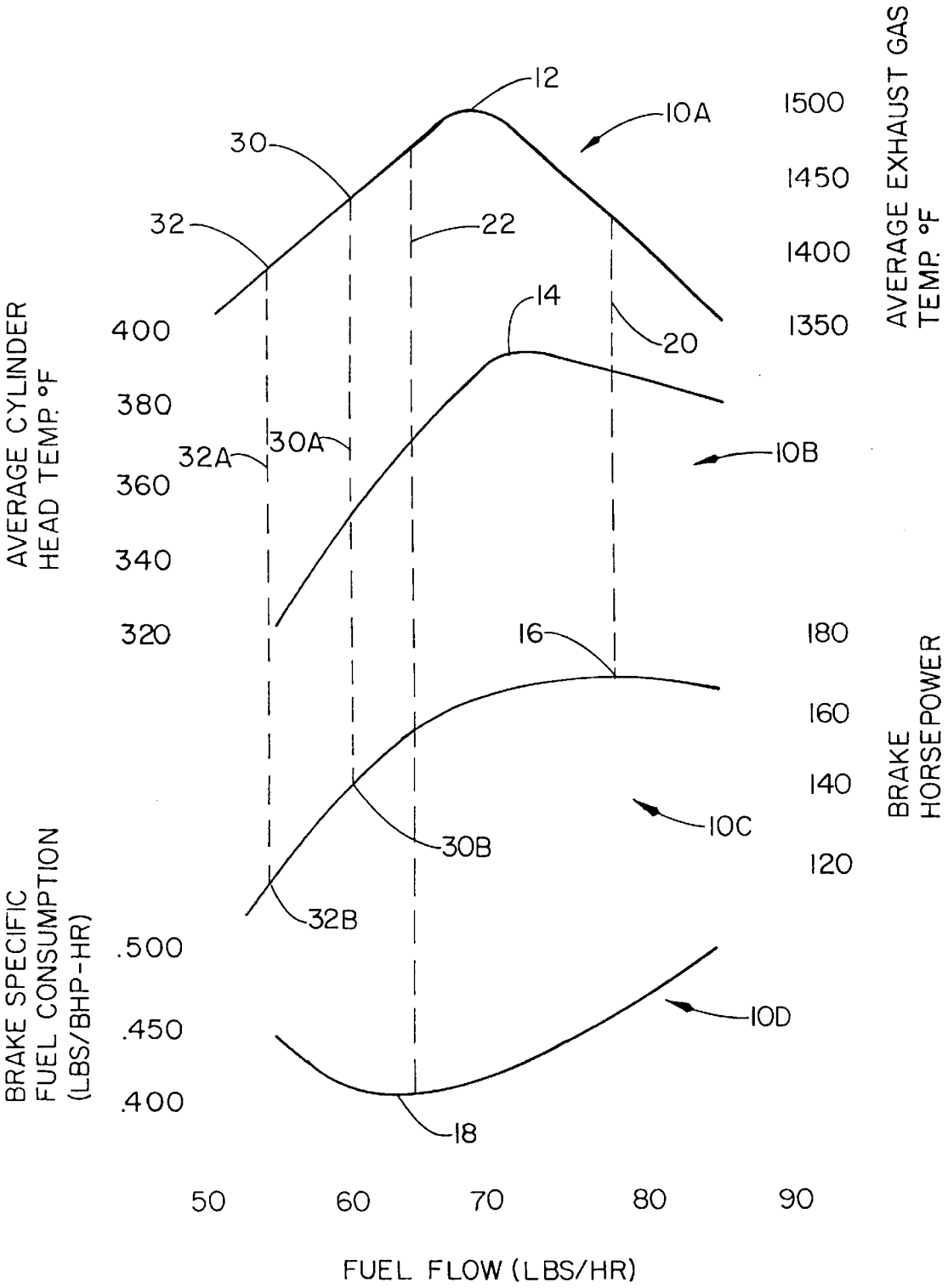
FIG. 1 depicts mixture ratio curves for an aircraft engine, model IO-550-B, as published by Teledyne Continental Motors.

Preliminarily, a brief discussion of the problem that the current invention solves is provided. One industry that relies on the port injected internal combustion engines is the aircraft industry. A large number of aircraft in operation today have engines manufactured by Teledyne Continental Motors (hereinafter "TCM"). FIG. 1 depicts TCM's published mixture ratio curves for a particular TCM engine, a model IO-550-B TCM, operating at 2300 RPM and 20.5" manifold pressure.

The four curves shown in FIG. 1 illustrate the engine's operating characteristics in terms of average EGT 10A, average cylinder head temperature 10B, average brake horsepower 10C, and average brake specific fuel consumption (BSFC) 10D. All four curves are plotted against a common abscissa, the total engine fuel flow (TEFF). The TEFF increases left to right from 50 to 90 lbs/hr, so one skilled in the art will recognize the charts as going from lean to rich from left to right.

The BSFC curve 10D of FIG. 1 provides a direct indication of the engine fuel efficiency, as it is a measure of the power produced for each pound/hour of fuel consumed. This curve has a characteristic shape and relationship to the EGT curve 10A. The EGT curve 10A is a function of the ratio of fuel to air in the combustion mixture, and as depicted in FIG. 1, is presented as a function of variation in fuel flow, with other engine parameters (induction air manifold pressure and engine speed) held constant. The EGT curve 10A of FIG. 1 is an average of the values obtained from each of the six exhaust streams from each of the six cylinders present in this particular engine arrangement. The peak EGT 12 is found at a stoichiometrically perfect ratio where all fuel and oxygen are consumed during combustion. At the peak EGT 12 the temperature of the exhaust gas will be at the maximum. Altering the fuel to air ratio either way from peak EGT 12 reduces the EGT. This is true whether the movement along the EGT curve is effected by increasing the fuel to air ratio, rich of peak, where there is excess fuel for combustion, or the movement is effected by decreasing the fuel to air ratio, lean of peak, where there is more oxygen than necessary to oxidize the available hydrocarbons.

The curves of FIG. 1 provide useful information independently, such as that at the stated engine operating conditions the peak EGT 12 occurs at about 68 lbs/hr fuel flow, peak average cylinder head temperature 14 occurs at about 71 lbs/hr fuel flow, maximum horsepower 16 is developed in the range of about 75 to 85 lbs/hr fuel flow, and minimum BSFC 18 occurs at about 63 lbs/hr fuel flow.

These curves also provide useful information collectively, such as by the extrapolation line 20 showing that maximum horsepower is developed at about 75 degrees rich of peak EGT 12, and by the extrapolation line 22 showing that the minimum value for BSFC 10D occurs from about 25 to 50 degrees lean of peak EGT 12. The average cylinder head temperature (hereinafter "CHT") curve 10B is closely correlated to the average EGT curve 10A. Characteristically, the maximum value of the CHT 10B occurs between 10 and 40 degrees rich of peak EGT 12.

From the mixture ratio curves of FIG. 1, it will be noted that certain advantages exist in operating on the lean side of peak EGT 12. First, in this range all average cylinder head temperatures are well below their maximum value. This is preferable to the peak EGT and the rich of peak EGT range where the cylinder head and its components can reach critical metallurgical temperatures at high power settings. Second, in the lean of peak EGT range the engine is extracting more horsepower per pound of fuel. This is important because range and payload of an aircraft are significantly affected by the fuel efficiency at which the engine can be operated. Third, in the lean of peak EGT range unburned hydrocarbons in the combustion chamber are reduced to a minimum value, resulting in reduced fouling of spark plugs and sticking of piston rings. Finally, dramatically reduced levels of carbon monoxide are produced which prevents a safety hazard to occupants of the vehicle cabin environment.

It will be noted from the curves of FIG. 1 that although it would be advantageous to reduce the fuel/air ratio to the lean side of peak EGT 12 to decrease cylinder head temperature and fuel consumption, doing so means accepting a decreased horsepower output from the engine. Generally this result is acceptable in a cruising flight mode where less horsepower is needed to sustain level flight than at other flight modes such as take-off and climb.

Figure 2:
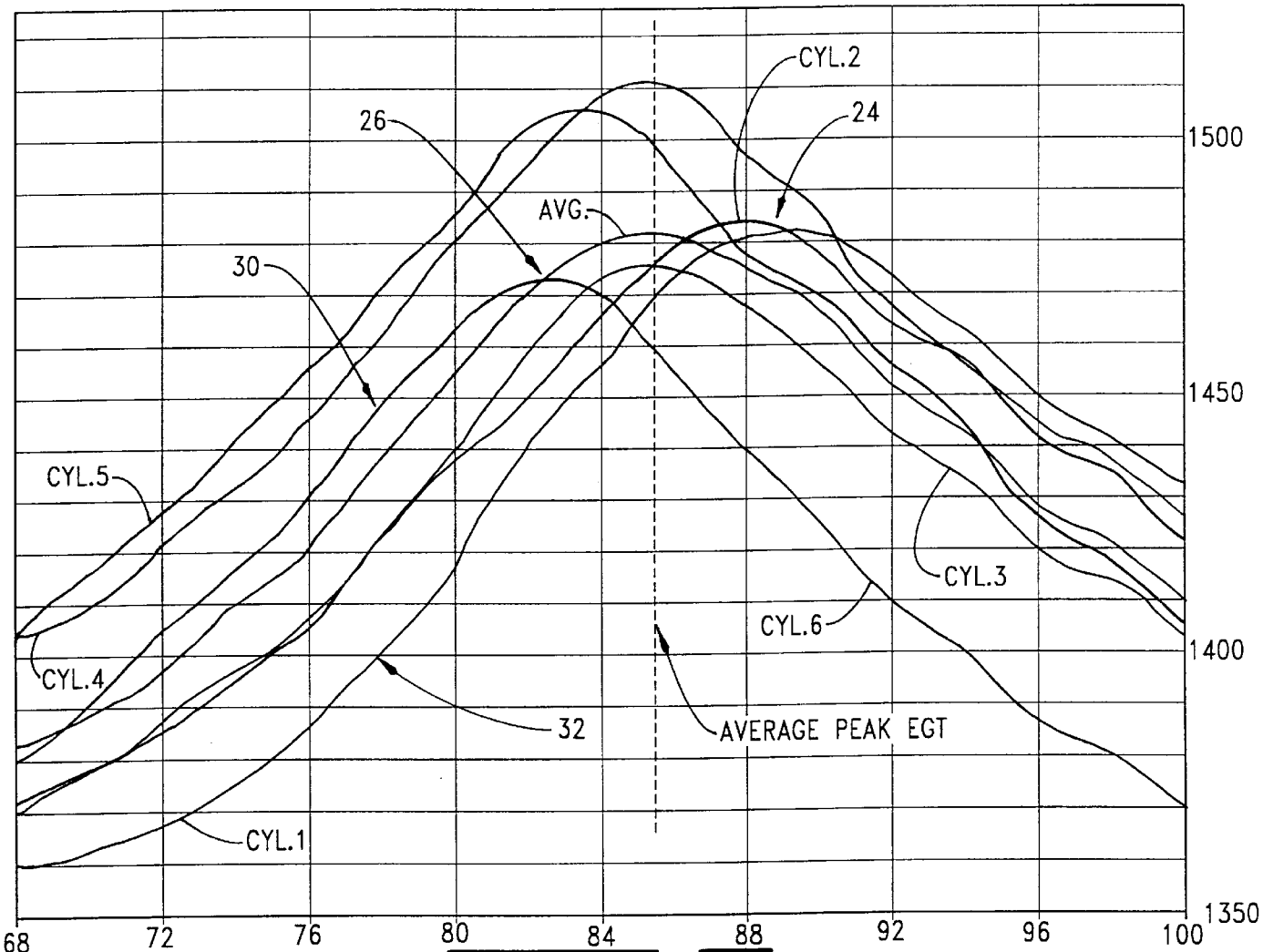
FIG. 2 is a graphical illustration of test data depicting the EGT for each of six combustion cylinders in a typical Teledyne Continental Motor engine, as published by General Aviation Modifications, Incorporated.

Many engines today, however, are incapable of operating lean of peak EGT 12 due to an uneven fuel to air ratio in all combustion cylinders. FIG. 2 shows a graphical summary of test data on a six cylinder TCM engine with each cylinder's EGT plotted against the total engine fuel flow. These are published curves of empirically derived data and are commonly known and used by persons skilled in the art. The average EGT curve 10A of FIG. 1 is an average of multiple curves like those of FIG. 2.

From the curves of FIG. 2 it will be noted that the individual cylinders reach a peak EGT at different total engine fuel flows. For example, cylinder 1 reaches peak EGT at about 89 pph (shown at 24) while cylinder 6 reaches peak EGT at about 82.5 pph (shown at 26). So even though the average EGT curve 10A of FIG. 1 shows that minimum brake specific fuel consumption will occur at 25 to 40° lean of peak EGT 12, that is just a theoretical value because the EGT curve 10A is a mathematic average of the individual cylinder's mixture ratio curves which reach peak EGT at different total engine fuel flows.

Where the individual cylinders are not aligned with peak EGT at a common total engine fuel flow, as shown in FIG. 2, then operation at any selected fuel flow occurs at different points on each cylinder's mixture ratio curve relative its peak EGT point. For example, FIG. 2 shows that cylinder 6 operates at 25° F. lean of peak, about 1448° F., at about 78 pph, as shown at 30. Cylinder 1 produces an EGT of about 1400° F. at 78 ppg, as shown at 32, which is about 85° F. lean of peak.

This disparity among cylinders in peak EGT versus total engine fuel flow corresponds to different power production by the cylinders. The horsepower curve 10C of FIG. 1 shows the power production in the range rich of peak EGT (see curve 10A ) is relatively flat. Contrarily, on the lean side of peak EGT the horsepower curve 10C slope is steep. Thus, when operating in the lean of peak EGT range variations in fuel to air ratio, indicated by variations in EGT, correspond to significant changes in horsepower.

For example, FIG. 1 shows the points 30 and 32 on the EGT curve 10A, these points being from the previous discussion of FIG. 2 wherein cylinder 6 operated 25° F. lean of peak EGT (shown at 30) and cylinder 1 operated at 85° F. lean of peak EGT (shown at 32) at a common total engine fuel flow. FIG. 1 shows that extrapolation of points 30 and 32 by lines 30A and 32A intersects the horsepower curve 10C at 30B and 32B, about 145 HP and 120 HP respectively. From these comparative points it will be noted that cylinder 6 will be producing 17% more horsepower than cylinder 1. This unbalanced power is transferred by the piston and rod to the crankshaft, causing the engine to run roughly.

In summary, many port injected internal combustion engines in service today inherently have cylinders which reach peak EGT at different total engine fuel flows. This construction limits the extent to which the engine can be operated in the lean of peak EGT range in order to conserve fuel and reduce engine temperature. Having addressed the effect of the problem, attention now is turned to the cause of the problem.

Figure 5:
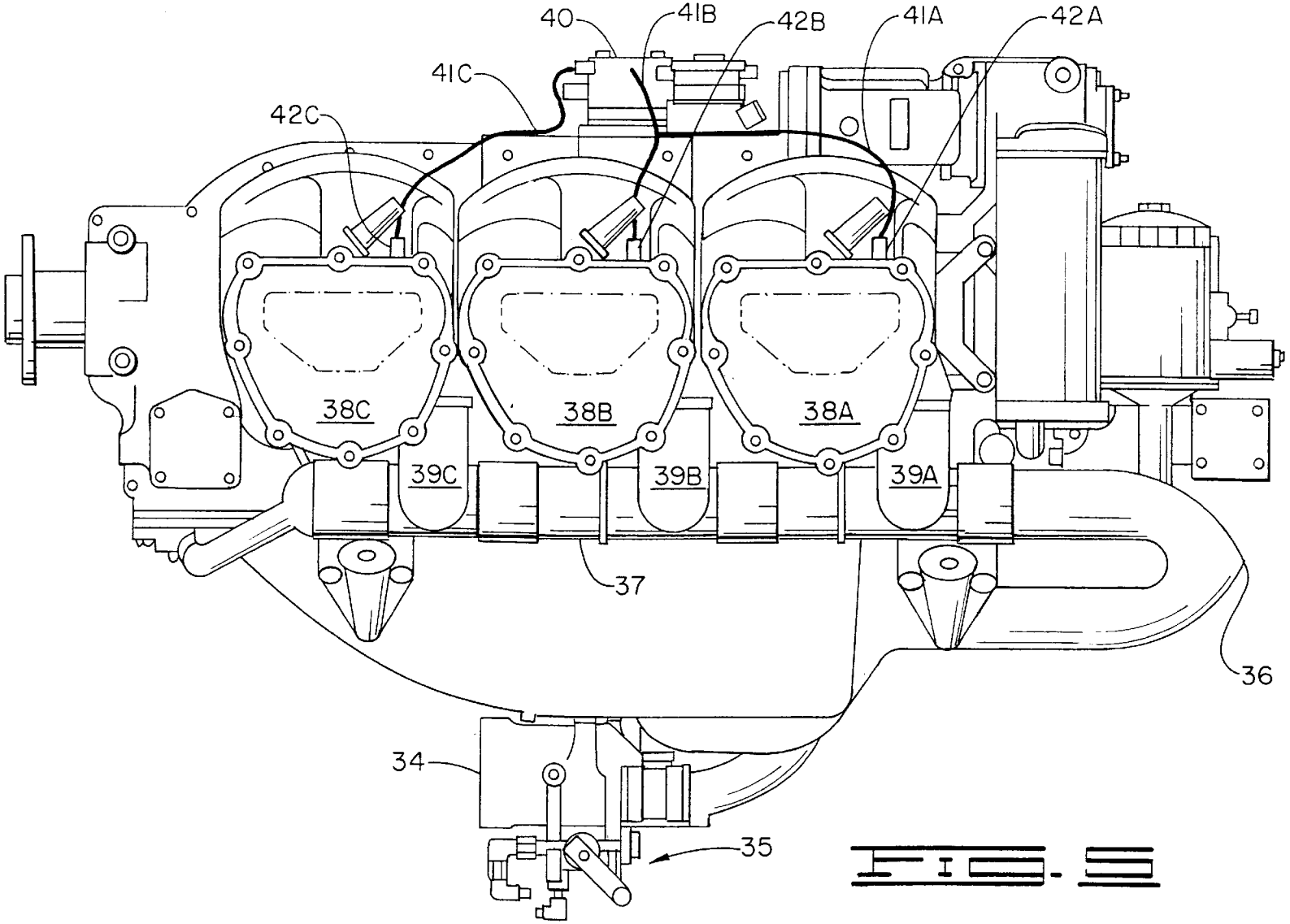
FIG. 5 is a diagrammatical side view of a port injected piston engine of the present invention having a runner-riser induction system and an injector matrix sized to provide a uniform fuel to air ratio to all cylinders.

The root cause of the fuel to air ratio imbalance has been suggested by others to be the result of an uneven distribution of combustion air to the engine cylinders. This problem undoubtedly occurs in a number of poorly engineered piston engines. On the other hand, it is clear that an uneven air distribution may contribute to the problem in some well-designed engines, but it is not the root cause of the fuel to air ratio imbalance. FIG. 5 shows the air distribution system on the majority of TCM engines, for example, which is constructed according to what is commonly known as a "runner-riser" air induction system, otherwise known as a"runner-log ranch" induction system. Typically, the air enters the engine at an intake 34 and passes through a throttle assembly 35, consisting of a movable "butterfly" throttle plate. Further downstream the modulated air flow is split at a Y-junction 36 where half of the air is directed along a runner 37 along the left hand bank of cylinders 38A, 38B, 38C (cylinders no. 2, 4 and 6) and a runner (not shown) along the right hand bank of cylinders (not shown, cylinders no. 1, 3 and 5). From each of the two runners (only 37 shown) there are risers (only 39A, 39B, 39C shown) that conduct combustion air to the intake ports of each respective cylinder 38A, 38B, 38C. The example of an engine made by TCM and employing a runner-riser induction system is illustrative only, and not intended to limit the scope of the present invention. There is a multitude of other air induction system arrangements well suited to the practice of the present invention, and the particular design of the induction system is not necessary to the teaching of the present invention.

However, others have referred to such "runner-riser" systems in addressing some of the issues addressed in this application. It is, therefore, pertinent to address the practice of the present invention to such systems. In these various systems, the other major portion of the fuel/air distribution system involves the distribution of fuel to each cylinder. The fuel is conducted from the fuel pump (not shown) through a metering mechanism (not shown, commonly actuated along with corresponding throttle and independent mixture control movements) and then to a small manifold 40 from which small stainless steel lines 41A, 41B, 41C extend and connect to fuel injectors 42A, 42B, 42C which are screwed into the intake port of each of the engine cylinders. These fuel injectors 42A, 42B, 42C typically operate continuously with a steady stream of metered fuel flowing into each intake port.

The purported theory that an air pressure differential exists in the runners 37 between upstream and downstream combustion cylinders would create an unbalanced air flow condition at all times, whether the fuel flow was set to produce either a lean or a rich mixture. Testing results and the experience of those skilled in the art, however, reveal that the cylinder to cylinder variations in power output (and thus, engine vibration) primarily exists when the engine is operated on the lean side of peak EGT fuel settings. In these same engines where roughness occurs in the lean of peak EGT range, the roughness typically does not occur in the rich of peak EGT range. Such could not be the case in the presence of a non-uniform air flow distribution. Since the fuel and air systems are independent of each other, changing the rate of fuel delivery does not affect the air flow distribution. This leads to the conclusion that if a substantially equalized air flow distribution exists so as to support a smooth running engine in the rich of peak range, then the equalized air flow distribution most likely exists at all fuel settings. The roughness at lean of peak conditions cannot be attributed to an air flow differential between upstream and downstream cylinders, despite widespread intuitive beliefs to the contrary.

The remedy according to the air flow distribution theory advocated matching the fuel injector sizes to a purported pressure differential across the runner, from the most upstream to the most downstream cylinders. According to this view, the middle cylinders were subjected to an average pressure, and so the fuel injectors there were not changed. The fuel injectors of cylinders upstream of the middle cylinders (cylinders 5 and 6) were iteratively reduced, and the fuel injectors of cylinders downstream of the middle cylinders (cylinders 1 and 2) were iteratively increased so as to match the fuel flow to the purported air flow gradient.

What the prior references in the area of runner-riser type induction systems fail to teach is that the cause of the unbalanced fuel/air mixture is not the result of air imbalance, but rather the result of occult transfer of fuel from upstream combustion cylinders to downstream combustion cylinders through the induction plumbing system.

Because the engines are four stroke engines, the intake valve on each respective cylinder is open approximately one-fourth of the time (with variations due to variations in cam shaft valve timing design). During the other (approximately) three-fourths of each complete engine cycle, the intake valve at each cylinder is closed. During that period of time when the intake valve is closed the fuel continues to be sprayed upon the intake valve guide where it forms a comparatively rich fuel/air vapor in the area in the intake port immediately adjacent to the intake valve and in the riser leading from the runner to the intake valve.

When the intake valve on one of the downstream combustion cylinders opens, it causes an inrush of air in the runner. That moving air temporarily and briefly creates a low pressure area, as is described by the well-known Bernoulli venturi effect. The low pressure area in the intake runner causes a portion of the rich fuel/air vapor that exists in an upstream riser to flow into the runner and to be transported downstream and to ultimately enter one of the downstream cylinders where it is burned. These processes which draw rich fuel/air vapor from an upstream cylinder's riser and deliver it to a downstream cylinder's riser define what is referred to herein as "occult fuel transfer." The occult fuel is thereby presented to a downstream cylinder for combustion along with the fuel normally provided by its own fuel injector. Thus, the fuel/air ratio in downstream cylinders is progressively more rich than the fuel/air ratio in upstream cylinders.

The prior references which teach an unbalanced air flow evidently assume an average air flow at the middle cylinders because it only compensates forward combustion cylinders 38A upstream and rear combustion cylinders 38C downstream of the middle cylinders 38B; it does not recommend compensation of the middle cylinders 38B. The present invention, contrarily, contemplates the effects of all upstream cylinders on downstream ones in the occult transfer of fuel. That is, cylinder no. 4 (38B) will receive occult fuel from cylinder no. 2 (38A), and cylinder no. 6 (38C) will receive occult fuel from cylinder nos. 2 (38A) and 4 (38B). By considering the downstream effects of occult fuel transfer, the present invention, if warranted, recommends compensating new size injectors for all cylinders, including the middle cylinders. The method described by this invention will, accordingly, also work with 4, 6, 8, or 12 cylinder engines.

Further, the present invention describes a method for balancing the fuel/air ratios in any engine with any arbitrary induction system, by reference to EGT data.

The present invention provides an improved optimization of engine operation that reduces engine vibration in the lean of peak EGT range, thereby offering practical reductions in fuel consumption and critical engine component operating temperatures.

Attention now is directed to the analytical approach of the present invention in arriving at a fuel injector matrix consisting of a matched set of fuel injectors that achieves a balanced fuel/air ratio to all cylinders. The following calculations are for an engine with "n" cylinders. The accompanying sample calculations of FIG. 3 are representative of an engine with six cylinders, so designated in line 1 as "Cyl 1" through "Cyl 6."

(a) $TEFF_x$ is the total engine fuel flow at which cylinder x reaches peak EGT. The $TEFF_x$ is empirically determined by testing with the injectors installed in the engine, by measuring the temperature of the exhaust gas while variably applying fuel to the engine over a selected range of total engine fuel flows. In the sample calculations of FIG. 3, the $TEFF_x$ is shown in line 2 and is expressed in units of pounds/hour.

(b) $TEFF_{avg}$ is the average of the total engine fuel flows where the individual cylinders reached peak EGT.

$$TEFF_{avg}=(\Sigma TEFF_x)/n$$

In the sample calculations of FIG. 3, $TEFF_{avg}$ is shown on line 2 as 85.3333 (PPH).

(c) $F_{n\text{-}fraction}$ is the total engine fuel flow of each cylinder at maximum EGT as a fraction of the average total engine fuel flow.

$$F_{n\text{-}fraction}=TEFF_x/TEFF_{avg}$$

In the sample calculations of FIG. 3, $F_{n\text{-}fraction}$ is shown on line 3.

(d) $P_{x\text{-}TEFF}$ is the percent rich (+) or lean (−) that cylinder x is running with respect to the average total engine fuel flow.

$$P_{x\text{-}TEFF}=100^*\ (1-F_{n\text{-}fraction})$$

In the sample calculations of FIG. 3, $P_{x\text{-}TEFF}$ is shown on line 4.

(e) $NF_{x\text{-}actual}$ is the observed injector flow rate of the injector from cylinder x at a common test pressure. $NF_{x\text{-}actual}$ is measured by removing the injectors from the engine and bench testing them. In the sample calculations of FIG. 3, the $NF_{x\text{-}actual}$ is shown on line 5 and expressed in units of pounds/hour (PPH).

(f) $NF_{avg\text{-}actual}$ is the average of the individual injector flow rate observations.

$$NF_{avg\text{-}actual}=(\Sigma NF_{avg\text{-}actual})/n$$

In the sample calculations of FIG. 3, $NF_{avg\text{-}actual}$ is shown on line 5 to be 29.3750 (PPH).

(g) $P_{x\text{-}actual}$ is the percent rich (+) or lean (−) that injector x is running with respect to the average injector flow.

$$P_{x\text{-}actual}=100^*\ ((NF_{avg\text{-}actual}/NF_{avg\text{-}actual})-1))$$

In the sample calculations of FIG. 3, $P_{x\text{-}actual}$ is represented on line 6.

(h) $P_{x\text{-}net}$ is the net percent rich (+) or lean (−) at which cylinder x is inherently operating, taking into account the values of TEFFx and adjusting for known injector size variations.

$$P_{x\text{-}net}=P_{x\text{-}TEFF}-P_{x\text{-}actual}$$

Note that correcting the fuel flow by the values defined by Px-net will equalize the cylinder to cylinder fuel to air ratios, the total fuel flow rate remains unchanged; therefore, $\Sigma P_{x\text{-}net}=0.0$ as is seen in the sample calculations of FIG. 3 on line 8.

(i) $S_{x\text{-}preliminary}$ is an intermediate calculation of injector resizing.

$$S_{x\text{-}preliminary}=F_{n\text{-}fraction}^*\ NF_{x\text{-}actual}$$

In the sample calculations of FIG. 3, $S_{x\text{-}preliminary}$ is represented on line 9.

(j) $S_{avg\text{-}preliminary}$ is also an intermediate calculation of average individual injector resizing.

$$S_{avg\text{-}preliminary}=(\Sigma S_{x\text{-}preliminary})/n$$

In the sample calculations of FIG. 3, $S_{avg\text{-}preliminary}$ is shown on line 9 to be 29.3773 PPH.

(k) $S_{x\text{-}resized}$ provides the recommended injector resize for each cylinder x so as to provide a balanced fuel/air ratio to all cylinders, and maintaining an average flow of the nozzles equal to the previous measured average flow of the existing injectors.

$$S_{x\text{-}resized}=S_{x\text{-}preliminary}^*\ (NF_{avg\text{-}actual}/S_{avg\text{-}preliminary})$$

In the sample calculations of FIG. 3, $S_{x\text{-}resized}$ is represented on line 10.

(l) $S_{avg\text{-}resized}$ is an average of the resized injectors based on the known flows of existing injectors.

$$S_{avg\text{-}resized}=(\Sigma S_{x\text{-}resized})/n$$

Note that although the fuel/air ratio is equalized by this method, the total fuel flow remains constant, therefore $S_{avg\text{-}resized}$ is equivalent to $NF_{avg\text{-}actual}$ as is seen in the sample calculations of FIG. 3 on lines 5 and 10.

(m) Alternatively, rather than resizing the existing injectors one may wish to install a new set of injectors. Where $S_{avg}$ is the average specified nozzle fuel flow rate, then $S_{x\text{-}new}$ is the new size of injector recommended for cylinder x so as to balance the fuel/air ratio in all cylinders.

$$S_{x\text{-}new}=S_{avg}^*(100-P_{x\text{-}net})/100$$

In the sample calculations of FIG.3, $S_{x\text{-}new}$ is represented on line 11.

(n) Recalculate the $TEFF_x$ to determine the total engine fuel flow at which the cylinders reach peak EGT. If all cylinders do not reach peak at a common total engine fuel flow, or within prescribed tolerance thereof, then repeating steps (a)–(m) will iteratively derive the desired orifice size to achieve the uniform fuel to air ratio at all cylinders such that all cylinders do reach peak EGT at a common total engine fuel flow.

The present invention thus provides an injector matrix for optimizing the efficiency of a port injected internal combustion engine by equalizing the fuel to air ratio in all combustion cylinders of the engine. The injector matrix may be selectively made to hold constant the existing average total fuel flow rate, and hence resize the existing injectors, or the injector matrix may be customized to provide an average specified total fuel flow rate. The injector matrix comprises a set of fuel injectors, one for each cylinder, each having a specified flow rate that compensates for existing disparities in fuel to air ratios among all cylinders to provide a uniform ratio to all cylinders. Primarily the injector matrix compensates for occult fuel transfer from upstream cylinders to downstream cylinders, and for inherent variation in actual to specified flow rate of individual injectors. The injector matrix also compensates for all other engine characteristics that result in an uneven fuel to air ratio among all cylinders, including but not limited to air flow and fuel flow differences among cylinders. The injector matrix of the present invention is not limited to the use in an engine using a runner-riser induction arrangement, rather it is suited for any arbitrary induction arrangement with a non-uniform fuel to air ratio in all cylinders.

Figure 4:
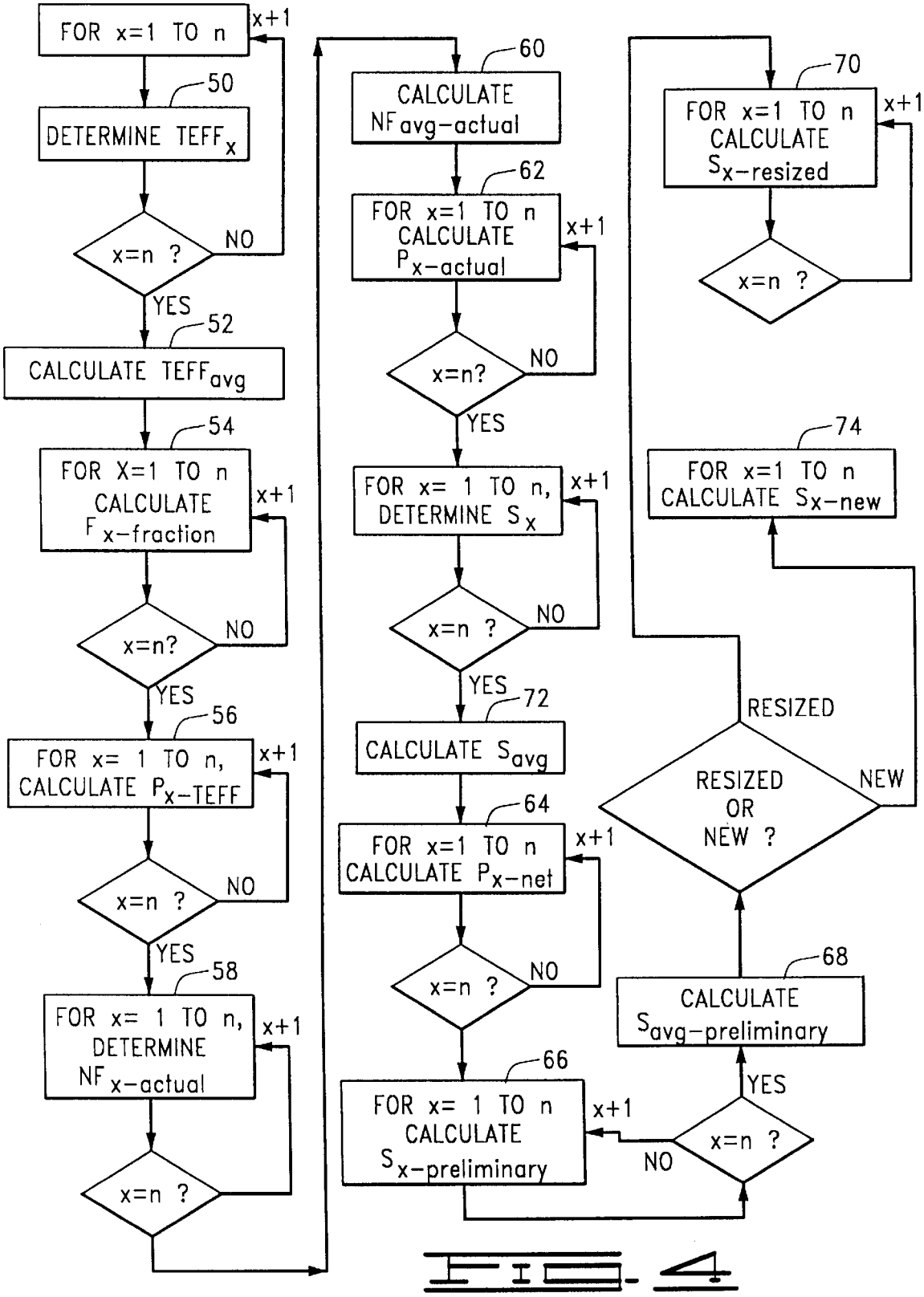
FIG. 4 is a flowchart illustrating the method of the present invention for determining the fuel injector matrix to balance the fuel to air ratio in all combustion cylinders of an internal combustion engine.

FIG. 4 shows the method by which the injector matrix of the present invention is determined. For an engine of n cylinders, first the total engine fuel flow at which each cylinder reaches peak EGT, $TEFF_x$ 50, and the average total engine fuel flows at peak EGT, $TEFF_{avg}$ 52, are determined. The total engine fuel flow of each cylinder at peak EGT as a fraction of the average total engine fuel flow, $F_{x\text{-}fraction}$ 54, is calculated in order to determine the percent rich or lean each cylinder is running, $P_{X\text{-}TEFF}$ 56, with respect to the average total engine fuel flow.

The injectors are removed from the engine for bench testing to determine the actual flow rates at a selected test pressure, $NF_{x\text{-}actual}$ 58, and the average of all tested injectors $NF_{avg\text{-}actual}$ 60 is calculated. The percentage rich or lean that each injector is running with respect to the average injector flow rate is calculated, $P_{x\text{-}tual}$ 62. The net percentage rich or lean, $P_{x\text{-}net}$ 64, is calculated which takes into account both the inherent variation of the fuel and air flow to each cylinder and the part-to-part variation of the injector flow rate. An intermediate calculation of the injector size, $S_{x\text{-}preliminary}$ 66, and the average of the preliminarily calculated injector sizes, $S_{avg\text{-}preliminary}$ 68, are calculated.

If the user of the present invention desires to resize existing injectors, then $S_{x\text{-}resized}$ 70 is calculated to provide the recommended injector resize for each cylinder so as to provide a balanced fuel to air ratio to all cylinders for combustion. Note that if the existing injectors are to be resized, then the total engine fuel flow is maintained as constant at $NF_{avg\text{-}actual}$ 60.

If, rather, the user of the present invention desires to replace the injectors so that the total engine fuel flow can be set at a specified value, $S_{avg}$ 72. Based on this specified total engine fuel flow, the new injector sizes, $S_{x\text{-}new}$, are calculated to provide the recommended new size injector for each cylinder so as to provide a balanced fuel to air ratio to all cylinders for combustion.

It will be clear that the present invention is well adapted to carry out the objects and attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

It will be readily understood that method steps in the appended claims can be carried out in an order differently from that set forth without affecting the scope of said claims.

While for purposes of disclosing a preferred embodiment an internal combustion engine has been discussed herein, it will be recognized that the present invention can be readily carried out in other types of engines that use a mixture of air and fuel to generate a driving torque.

What is claimed is:

1. In an engine of the type having a plurality of combustion chambers for combusting air and fuel to provide a driving torque, each chamber having an associated air manifold portion and a fuel delivery line for supplying the air and fuel, respectively, to the chamber, each chamber further having a fuel injector in communication with the associated fuel delivery line for metering the fuel by way of an orifice sized to establish a selected fuel to air ratio for the chamber and an associated exhaust manifold portion for facilitating the removal of exhaust gas from the chamber, a method for selecting an optimal size for each of the fuel injector orifices to achieve a desired operational performance level for the engine comprising the steps of:

(a) measuring temperature of the exhaust gas removed from each chamber while variably applying fuel to the engine over a selected range of total engine fuel flow rates;

(b) identifying the actual engine fuel flow rate at which a maximum temperature of the exhaust gas is reached;

(c) measuring a bench fuel flow rate for each fuel injector;

(d) determining an average bench fuel flow rate;

(e) determining an average total engine fuel flow rate from the actual engine fuel flow rates;

(f) determining a preliminary orifice size for each fuel injector in relation to the associated bench fuel flow rate and the average total engine fuel flow;

(g) determining a final orifice size for each fuel injector in relation to the associated preliminary orifice size and the average bench fuel flow rate; and (h) selecting a final set of fuel injectors having orifice sizes corresponding to the final orifice sizes.

2. An engine, comprising:

a plurality of combustion chambers for combusting air and fuel;

a plurality of air intake manifold portions, coupled to the combustion chambers, which supply the air to the combustion chambers;

a plurality of fuel delivery lines, coupled to the combustion chambers, which supply the fuel to the combustion chambers;

a plurality of exhaust manifold portions, coupled to the combustion chambers, which vent exhaust gas from the combustion chambers;

a plurality of fuel injectors, coupled to the fuel delivery lines, which meter the fuel and establish a fuel to air ratio in relation to a size of an orifice of each of the fuel injectors, the size of the orifice of each of the fuel injectors optimized by:

installing an initial set of fuel injectors;

measuring temperature of the exhaust gas removed from each chamber while variably applying fuel to the engine over a selected range of total engine fuel flow rates;

identifying the actual engine fuel flow rate at which a maximum temperature of the exhaust gas is reached in each chamber;

removing and measuring a bench fuel flow rate for each of the initial set of fuel injectors;

determining an average bench fuel flow rate;

determining an average total engine fuel flow rate from the actual engine fuel flow rate for each chamber;

determining a preliminary orifice size for each of the initial set of fuel injectors in relation to the associated individual fuel flow rate and the average total engine fuel flow rate; and determining the optimum orifice size in relation to the associated preliminary orifice size and the average bench fuel flow rate.

3. An improved engine having a plurality of internal combustion cylinders wherein fuel and air are variably mixed to form fuel to air ratios suitable for combustion, the engine having a fuel delivery line on each cylinder for supplying fuel thereto, and having an air manifold with a delivery end on each cylinder for supplying combustion air thereto, and furthermore having an exhaust manifold with a portion on each cylinder to carry exhaust gas away from the cylinder, wherein the temperature of the exhaust gas is a result of the fuel to air ratio and the total engine fuel flow is the total fuel flow through the fuel delivery lines, the improvement comprising:

a matrix of fuel injectors, the matrix comprising a fuel injector on each cylinder fluidly communicating fuel from the fuel delivery line to the cylinder, wherein each of the fuel injectors is characterized by a fuel passageway and an orifice in the passageway for metering a desired flow rate of fuel to the cylinder, wherein the size of each orifice is determined by a process comprising the steps of:

(a) determining the total engine fuel flow, $TEFF_x$, at which the cylinder reaches a peak exhaust gas temperature;

(b) calculating the average of the total engine fuel flows, $TEFF_{avg}$, in relation to the total engine fuel flows, $TEFF_x$, at which each of the cylinders reaches a peak exhaust gas temperature;

(c) determining the actual fuel flow of the fuel injector, $NF_{x\text{-}actual}$, at a selected test pressure;

(d) calculating the average of all fuel injector flow rates, $NF_{avg\text{-}actual}$, at a selected test pressure in relation to the flow rate $TEFF_x$ of all injectors;

(e) calculating a preliminary size, $S_{x\text{-}preliminary}$, in relation to the fuel injector fuel flow, $NF_{x\text{-}actual}$, the cylinder peak exhaust gas temperature fuel flow, $TEFF_x$, and the average total engine fuel flow, $TEFF_{avg}$; and (f) calculating the average of all preliminary sizes, $S_{avg\text{-}preliminary}$, in relation to the preliminary size $S_{x\text{-}preliminary}$, of all injectors;

(g) calculating the size of the orifice, $S_{x\text{-}resized}$, in relation to the preliminary size, $S_{x\text{-}preliminary}$, the average fuel injector flow, $NF_{avg\text{-}actual}$, and the average preliminary size, $S_{avg\text{-}preliminary}$; and (h) repeating steps (a)–(g) as necessary to iteratively derive a size whereby all cylinders reach peak exhaust gas temperature at a common total engine fuel flow, $TEFF_x$.

4. An improved engine having a plurality of internal combustion cylinders wherein fuel and air are variably mixed to form fuel to air ratios suitable for combustion, the engine having a fuel delivery line on each cylinder for supplying fuel thereto, and having an air manifold with a delivery end on each cylinder for supplying combustion air thereto, and furthermore having an exhaust manifold with a portion on each cylinder to carry exhaust gas away from the cylinder, wherein the temperature of the exhaust gas is a result of the fuel to air ratio and the total engine fuel flow is the total fuel flow through the fuel delivery lines, the improvement comprising:

a matrix of fuel injectors, the matrix comprising a fuel injector on each cylinder fluidly communicating fuel from the fuel delivery line to the cylinder, wherein each of the fuel injectors is characterized by a fuel passageway and an orifice in the passageway for metering a desired flow rate of fuel to the cylinder, wherein the size of each orifice is determined by a process comprising the steps of:

(a) determining the total engine fuel flow, $TEFF_x$, at which the cylinder reaches a peak exhaust gas temperature;

(b) calculating the average of the total engine fuel flows, $TEFF_{avg}$, in relation to the total engine fuel flows, $TEFF_x$, at which each of the cylinders reaches a peak exhaust gas temperature;

(c) calculating a cylinder percentage difference in flow, $P_{x\text{-}TEFF}$, in relation to the peak exhaust gas temperature flow, $TEFF_x$, and the average total engine fuel flow $TEFF_{avg}$;

(c) determining the actual fuel flow of the fuel injector, $NF_{x\text{-}actual}$, at a selected test pressure;

(d) calculating the average of all fuel injector flow rates, $NF_{avg\text{-}actual}$, at a selected test pressure in relation to the flow rate $TEFF_x$ of all injectors;

(e) calculating the injector percentage difference in flow, $P_{x\text{-}actual}$, in relation to the injector fuel flow, $NF_{x\text{-}actual}$ and the average injector fuel flow, $NF_{avg\text{-}actual}$;

(f) calculating the net percentage difference, $P_{x\text{-}net}$, in relation to the cylinder percentage difference in flow, $P_{x\text{-}TEFF}$, and the injector percentage difference in flow, $P_{x\text{-}actual}$;

(g) calculating the size of the orifice in relation to an average specified flow rate $S_{avg}$ and the net percentage difference, $P_{x\text{-}net}$; and (h) repeating steps (a)–(g) as necessary to iteratively derive a size whereby all cylinders reach peak exhaust gas temperature at a common total engine fuel flow, $TEFF_x$.

* * * * *